United States Patent [19]

Feiler et al.

[11] 4,371,121

[45] Feb. 1, 1983

[54] YARN WINDING DEVICE

[75] Inventors: Horst Feiler, Ebersbach; Gunter Konig, Uhingen-Baiereck, both of Fed. Rep. of Germany

[73] Assignee: Zinser-Textilmaschinen GmbH, Ebersbach, Fed. Rep. of Germany

[21] Appl. No.: 288,452

[22] Filed: Jul. 30, 1981

[30] Foreign Application Priority Data

Jul. 30, 1980 [DE] Fed. Rep. of Germany ..... 3028826
Jun. 5, 1981 [DE] Fed. Rep. of Germany ..... 3122385

[51] Int. Cl.[3] ..... B65H 54/02; B65H 54/28

[52] U.S. Cl. ..... 242/18 DD; 242/18 R; 242/18 G; 242/26; 242/43 R; 242/43.1

[58] Field of Search ..... 242/18 DD, 18 G, 18 R, 242/18.1, 26, 43 R, 43 A, 43.1, 27, 31, 158 R

[56] References Cited

U.S. PATENT DOCUMENTS 3,933,319 1/1976 Sachleben, Sr. et al. ..... 242/18 R
4,085,903 4/1978 Kuhnemann ..... 242/43.1

*Primary Examiner*—Stanley N. Gilreath
*Attorney, Agent, or Firm*—Antonelli, Terry and Wands

[57] ABSTRACT

A high speed yarn winding device performing a parallel winding, with the winding having yarn windings which intersect within each winding layer. The parallel winding is formed on a sleeve rotatably and interchangeably mounted on a carrying device through a driven friction roller. The friction roller is partially looped by the yarn to be wound on and a yarn winding body involved in a winding of the yarn abuts at its outer circumference with the friction roller. A guide bar is adapted to execute lifting movements parallel to an axis of rotation of the friction roller, with the bar carrying a rotatably mounted wheel driven by the yarn fed to it and coming in contact with it and superimposing much more rapid and shorter modulating strokes on the relatively slow lifting movements of the guide bar. To improve the winding conditions of the yarn and the composition of the parallel winding, the wheel has at least one round drive surface concentric to the axis of rotation. The yarn cooperates with the drive surface so as to drive the wheel. A yarn transport device is connected in series with the wheel and delivers the yarn to at least one yarn deflecting element disposed concentrically on the wheel. At least one yarn deflecting element deflects the yarn to the friction roller.

18 Claims, 14 Drawing Figures

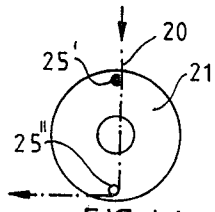
FIG.4A
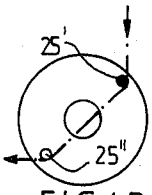
FIG.4B
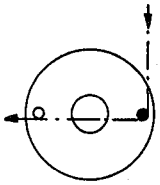
FIG.4C
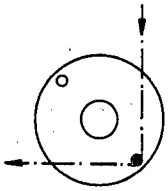
FIG.4D
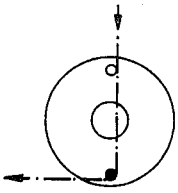
FIG.4E
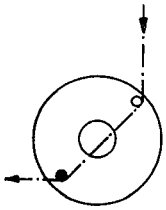
FIG.4F
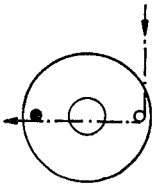
FIG.4G
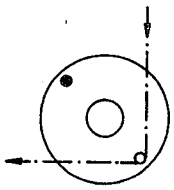
FIG.4H
FIG.5A
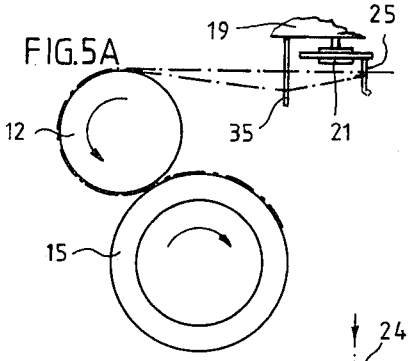
FIG.5B
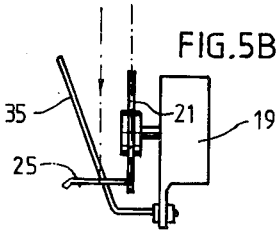
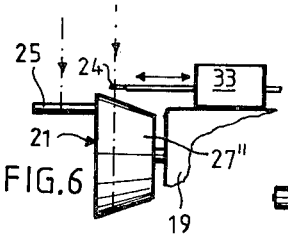
FIG.6
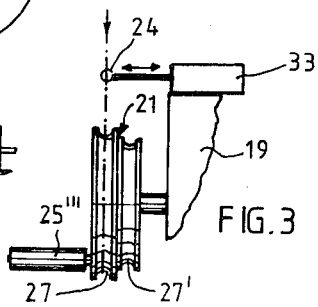
FIG.3

YARN WINDING DEVICE

The present invention relates to a winding device and, more particularly, to a yarn winding device for winding yarn at high winding speed so as to form a parallel winding onto a casing, with the winding including yarn windings which intersect within each winding layer. The casing is rotatably and interchangeably held on a carrying device by preferably a cylindrical driven frictional roller with a preferably vertical axis of rotation. The friction roller is partially looped by the yarn to be wound with the yarn winding body, involved in the winding, abutting the friction roller at its outer circumference for the rotary drive and for directly supplying the yarn to it. A guide bar executes lifting movements parallel to an axis of rotation of the friction roller, with the bar carrying a rotatably mounted wheel. The wheel is driven by the yarn feed to it from a first yarn transport device and coming in contact with it. The wheel deflects the yarn to the friction roller thereby superimposing much more rapid and shorter modulating strokes on the relatively slow lifting movements of the guide bar which serve to wind the yarn in a parallel winding resulting in intersecting of the yarn windings within the individual winding layers.

Yarn winding devices of the aforementioned type are preferably used on texturing machines and, more particularly, false-twist machines, since such devices permit high yarn winding speeds of, for example, 400 to 1000 meters per minute or more; however, such yarn winding devices can also be provided on other types of textile machinery.

The term yarn should be understood to refer to all types of threads windable on such winding devices, including continuous filament, thread from natural fibers and man-made fibers, filaments, individual filaments, ply yarn, and the like.

By virtue of a yarn winding device constructed in accordance with the present invention, windings are produced which have a high winding density, with the winding density being the number of yarn windings per shift stroke, which may be called parallel windings because, if the modulating strokes did not occur, the yarn would be displaced only by relatively slow long strokes of the guide bar and would thus be wound into a pure parallel winding in a conventional sense and not into a cheese, cross-wound bobbin. However, the modulating strokes result in a mutual intersection of the yarn windings which are wound on during one stroke of the guide bar. The yarn windings which are wound on during one stroke (the rising stroke or falling stroke) of the guide bars are referred to as a winding layer. Hence, the yarn windings of the individual winding layer intersect as a result of the modulating strokes and the winding can be referred to as a parallel winding with the yarn windings intersecting within each winding layer.

Moreover, the expression "mirror" of the yarn winding element involved in winding may be understood as follows. If the yarn is displaced only by the lifting movements of the guide bar and no modulating strokes occur, patterns will develop at certain diameters of the outer circumference of the yarn winding body. The patterns may begin as a diamond pattern and then change into helical bands as the winding progresses and, in the case of filament yarns, may finally produce a smooth mirror-like appearance at the circumference which then disappears again as the winding continues in the opposite sequence. A disadvantage of the occurrence of the mirror-like appearance resides in the fact that the presence of the mirrors disturb the winding development and may even result in a pull-off problem when the yarn is later unwound. Moreover, in, for example, filament yarns, the occurrence of the mirrors may even be to yarn splitting and tearing. Additionally, the mirror formation occurring during a winding-on, may cause the yarn winding element involved in the winding to run roughly and noisily.

In Offenlegungsschrift No. 2,651,816, a yarn winding device is proposed and a yarn deflecting element is constructed as an eccentric disc with a circular yarn groove. The disc superimposes much shorter modulatingg strokes on the long relatively slow rising and falling strokes of a guide bar. The modulating strokes wind the yarn with a continuously changing pitch angle, with the yarn windings thus intersecting within each winding layer causing the yarn winding body to hold together better and even facilitate the subsequent unwinding of the yarn.

A disadvantage of the last-proposed construction resides in the fact that a ratio V of a length of the individual modulating stroke of the yarn to the length of the yarn wound on during the modulating stroke, which ratio is critical for an angle of intersection of the crossing yarn windings, is relatively small because the eccentricity of the eccentric disc, driven by the yarn, cannot be made too large. Additionally, angular delays and angular accelerations of the eccentric disc may occur during each turn, may have an unfavorable effect upon the driving yarn and may even reduce the admissible winding speed of the yarn. Furthermore, a winding tension of the yarn must be relatively high.

The aim underlying the present invention essentially resides in providing a device for winding yarn at high winding speeds which is able to achieve significantly higher V ratios.

In accordance with advantageous features of the present invention, a yarn winding device is provided which include a wheel having at least one round driving surface concentric with respect to its axis of rotation, with the wheel adapted to be driven by the yarn fed to the wheel by a first yarn transport device. A second yarn transport device may be connected in series with the wheel, with the second yarn transport device feeding the yarn to at least one yarn deflecting element mounted eccentrically on the wheel. The yarn deflecting element deflects the yarn to a friction roller.

By virtue of the above-noted features of the present invention, the wheel is driven by the yarn as it travels from the first to the second yarn transport device and only then does the yarn run from the second yarn transport device over at least one yarn deflecting element, mounted eccentrically on the wheel and generating the modulating strokes, to the friction roller. In this manner, the yarn length which extends from the second yarn transport device to the friction roller is free of being driven by the wheel and is therefore subjected to considerably lesser stress than previously proposed constructions. Additionally, the winding tension of the yarn may be much less than previous constructions and even nearly zero-tension winding on of the yarn is possible.

In addition to the present invention achieving higher V ratios, much greater crossing angles of the yarn windings in the winding may also be achieved thereby resulting in a considerable improvement in the holding together of the winding. Moreover, if the winding has at least one tapered end, much greater taper angles may be provided than previously achieved so that the winding contains more yarn for a given axial length.

In some instances it may also be possible in accordance with the present invention to make at least one end of the winding planar or flat. Subsequent unwinding of the yarn from the winding is easier and even poses less problems than before when pulled off over the head. With the case of filament yarns, a danger of yarn splitting and subsequent yarn tearing during pull off is eliminated or at least considerably reduced.

Since the present invention permits winding yarn with much lower yarn tension, less hard windings than previously attained may readily be produced and, if desired, even soft windings may be produced. The relatively high yarn winding tensions that were previously necessary always produced very hard yarn winding bodies and often even resulted in the winding compressing the sleeve supporting it, if the sleeve was not made of metal but rather out of cardboard or the like.

Generally it is especially advantageous in accordance with the present invention to provide a single yarn deflecting element; however, in some situations a plurality of yarn deflecting elements may advantageously be provided, with the elements cooperating to deflect the yarn to the friction roller thereby permitting some changes in length of the yarn between the second yarn transport device and friction roller during the modulating stroke and possibly also even higher frequencies for the modulating stroke and even smaller wave lengths for the sine waves in which the yarn is wound.

An area of the yarn deflecting element which deflects the yarn may preferably, in accordance with the present invention, be mounted straight and cylindrical and axially parallel to the axis of rotation of the wheel. Advantageously, the straight cylindrical area of the yarn deflecting element may have a small maximum diameter of 4 mm and, advantageously, between 1 and 3 mm. An extremely easy structural arrangement of the yarn deflecting element may be achieved by constructing the yarn deflecting element as a straight pin which is permanently mounted endwise on the wheel.

In accordance with further features of the present invention, in some situations, the yarn deflecting element may also be a roller eccentrically mounted on the wheel and rotatable about its longitudinal axis, with an axis of rotation of the roller being directed axially parallel to the wheel. This may be advantageous in many cases for delicate yarns in order to prevent the delicate yarns from rubbing on the yarn deflecting element.

The modulating stroke movements cause changes in the length of the yarn length which extends from the second yarn transport device to the friction roller and is deflected by the yarn deflecting element. In order to reduce this change or variation in length, in accordance with further features of the present invention, the yarn may be laterally deflected from its shortest path on its way from the yarn deflecting element to the friction roller by a deflecting bar which is directed diagonally to it and is firmly mounted on the guide bar in such a fashion that the back and forth movements which occur in time with the modulating strokes reduce the changes or variations in length of the yarn on this guide bar.

The first and second yarn transport devices may be of a conventional construction and may be adapted to transport the yarn in a non-slip manner at an appropriately set, preferably constant speed. Advantageously, the yarn transport devices may be constructed as godets with associated deflecting rollers. In this connection, it is possible to provide a separate first yarn transporting device forwardly or upstream of the driving surface of the wheel, as viewed in a yarn feeding direction with the first yarn transporting device then only feeding yarn to the driving surface of the wheel and not the deflecting element.

For structural simplicity, the second yarn transport device may be the same as the first yarn transport device and, preferably, constructed as a single driven godet. More particularly, the yarn may be fed from above and envelop the godet and then run or extend to the driving surface of the wheel thereby causing the wheel to rotate the yarn, then return to the yarn transporting device where it again envelops the godet and the wheel is rotated and thereby the yarn is transported to the yarn deflecting element arranged at the wheel and directed to the winding element. Thus, the first yarn transporting device may be constituted by a right side of the roller of the yarn transporting device since the yarn first envelops or surrounds the right portion for its drive and then runs to the driving surface of the wheel and continues back to the left side portion of the roller of the transport device and then thereby again activated or driven and finally transported to the deflecting element. Consequently the left side portion of the roller could constitute a second yarn transporting device.

The build up of the yarn windings may be considerably improved in this fashion and mirror formation may be suppressed even at smaller modulating strokes in accordance with the present invention by providing that the wheel include a plurality of drive surfaces of different diameters with a yarn guide being provided and disposed in such a fashion so as to be adjustable position-wise approximately parallel to an axis of rotation of the wheel. By means of the guide, the yarn may be displaced to change or vary the rotational speed of the wheel interchangeably to the drive surfaces of different diameters by means of a position adjustment device actuatable by a drive means. Preferably, the drive may be used for periodically moving the yarn guide back and forth so that the rotational speed of the wheel changes periodically; however, aperiodic movement of this yarn guide is often helpful further to eliminate or break down mirror formation.

In accordance with the present invention, the different yarn support surfaces on the wheel are formed by angular grooves. It is also possible for the yarn support surfaces of different diameters to be formed by a single frustoconical surface.

Advantageously, the yarn may be deflected, on its way from the yarn deflecting element to the friction roller, by a deflecting guide which is oriented diagonally with respect to the yarn and permanently attached to the guide bar. The yarn may be deflected out of its shortest path to the friction roller diagonally with respect to the modulating stroke direction in such a manner that the changes in length of the yarn length which is located between the second yarn transport device and the running-on point of the yarn on the friction roller are reduced, with the changes in length being caused by the modulating strokes.

Advantageously, the winding device of the present invention is designed or constructed so as to produce parallel windings with tapered ends.

Accordingly, it is an object of the present invention to provide a yarn winding device which avoids, by simple means, shortcomings and disadvantages encountered in the prior art.

Another object of the present invention resides in providing a yarn winding device which sujects the yarn to lesser stress and tension than previously proposed winding devices.

Yet another object of the present invention resides in providing a yarn winding device which enables a subsequent unwinding of the yarn without subjecting the yarn to damage.

A further object of the present invention resides in providing a yarn winding device which permits substantially higher yarn-winding speeds.

A still further object of the present invention resides in providing a yarn winding device which enables the production of less hard or even soft windings.

These and other objects, features, and advantages of the present invention will become more apparent from the following description when taken in connection with the accompanying drawings which show, for the purposes of illustration only, several embodiments in accordance with the present invention, and wherein:

FIG. 3 is a partially schematic view of a wheel of another embodiment of a yarn winding device constructed in accordance with the present invention;

FIGS. 4A–4H are end views of alternate wheel constructions provided with two pins for a yarn winding device constructed in accordance with the present invention;

FIG. 5A is a top view of a yarn winding device constructed in accordance with the present invention which includes a wheel, friction roller, and a deflecting bar continuously shifting yarn back and forth at right angles to modulating strokes;

FIG. 5B is a side elevational view, on an enlarged scale, of the wheel and deflecting bar of FIG. 5A; and FIG. 6 is a side elevational view of another embodiment of a wheel for a yarn winding device constructed in accordance with the present invention.

Figure 1:
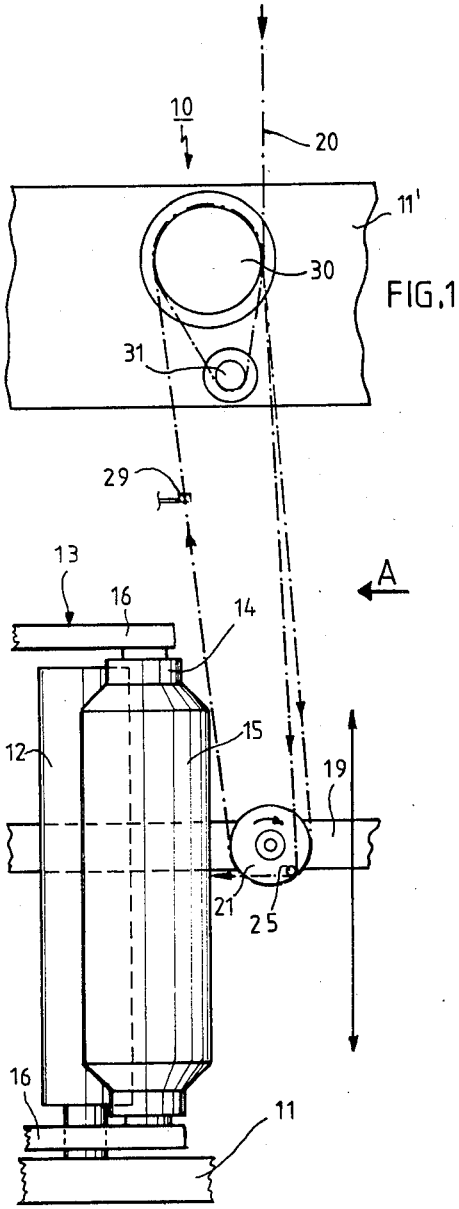
FIG. 1 is a partially schematic front view of a yarn winding device constructed in accordance with the present invention.
Figure 2:
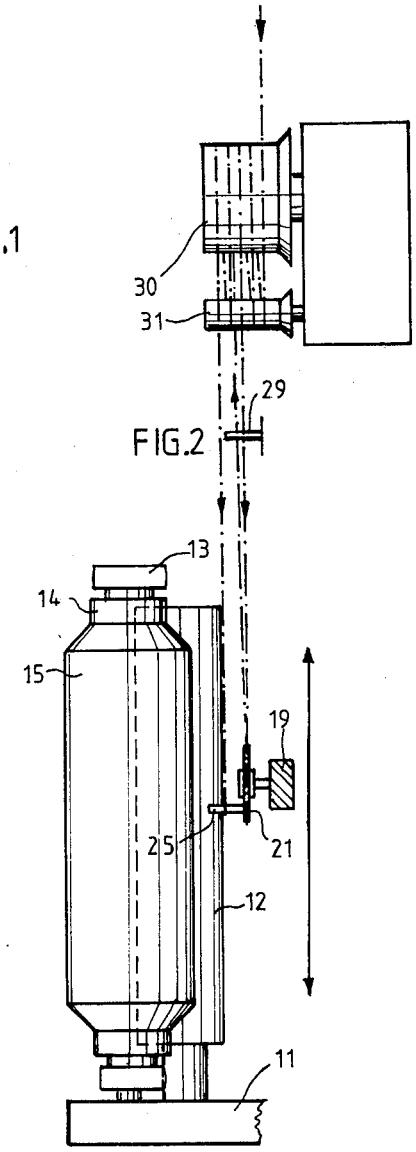
FIG. 2 is a side elevational view of the yarn winding device of FIG. 1 taken in the direction of the arrow A.

Referring now to the drawings when like reference numerals are used throughout the various views to designate like parts and, more particularly, to FIG. 1, according to this figure, a yarn winding device generally designated by the reference numeral 1 is mounted on a frame of a textile machine, with the frame including frame parts 11, 11'. The textile machine is capable of having a plurality of yarn winding devices 10 mounted thereon. Preferably, the textile machine may be a texturing machine, but other types of textile machinery may also be involved as well.

The yarn winding device 10 includes a cylindrical friction roller 12 arranged so as to be rotatable about a vertical axis. The roller 12 is driven during operation at a high, preferably constant circumferential velocity, with a bottom rotary bearing of the roller 12 being arranged in the frame part 11. A sleeve 14 is rotatably and interchangeably mounted on a carrier device generally designated by the reference numeral 13 which is pivotably about a vertical axis of rotation. The sleeve 14 or a yarn winding body 15, which is wound onto the sleeve after a winding of the yarn begins, is pressed against the friction roller 12 so that the friction roller 12 winds up yarn 20 transported by its on the yarn winding body 15 preferably at a constant winding speed.

The sleeve 14 which serves as a yarn carrier is advantageously cylindrical so that even the yarn winding body 15 which is located on it during winding of the yarn 20 has a cylindrical circumferential surface with tapered ends at the top and bottom. The longitudinal axes of the sleeves 14 and friction roller 12 are parallel to one another so that the friction roller 12 and initially sleeve 14 and later yarn-winding body 15 have their circularly cylindrical circumference in contact along their respective generating lines.

The carrying device 13 includes two arms 16 and a vertical shaft (not shown) for supporting the carrying device 13. The shaft is pivotably mounted in the frame part 11 to pivot about an axis of rotation parallel to the friction roller 12 and is subjected to a torque by springs, weights, or the like, so that the sleeve 14 or the yarn-winding body 15 located thereon during a winding of the yarn 20 is constantly pressed against the friction roller 12 during operation of the yarn winding device 10. A guide bar 19 is located behind the friction roller 12 and at a distance therefrom. The guide bar 19 is driven by a suitable drive means (not shown) so as to produce long, relatively slow vertical lifting movements with one stroke lasting, for example, about 30 seconds. The guide bar 19 and associated drive means serve to shift the yarn 20 with respect to the double tapered yarn-winding body 15 and forms a parallel winding with yarn windings which intersect in each winding layer. For example, the stroke of the guide bar 19 may be reduced from a maximum value slowly to a minimum value over an entire winding process of the yarn 20; however, there are other possibilities as well.

For example, a wheel 21, described more fully hereinbelow, could be disposed on the guide bar 19 so that it would pivot upward and downward relative to the guide bar 19 by way of a lever supporting it on the guide bar so that the predetermined automatic pivoting or swiveling of the lever could adjust the height of the individual winding layers to a predetermined or preset height during a winding on of the yarn with one winding layer being wound on the winding body 15 during each stroke of the guide bar 19. By an appropriate pivoting of the lever, the tapered ends of the winding body 15 could readily be produced. It is also possible to wind the yarn 20 in such a manner that the parallel winding is tapered at only one end and is flat at the other end or, for example, such that the winding is flat on both ends.

The wheel 21 for each yarn winding device 10 is rotatably mounted on the guide bar 19 so as to be rotatable about a horizontal axis of rotation. The guide bar 19 advantageously extends along all of the yarn winding devices 10 located on the side of the machine in question. Each wheel 21 has a round circumferential driving surface formed with, for example, a groove coaxial to the axis of rotation for accommodating the yarn driving the respective wheel. The yarn 20 is fed to the circumferential groove of the wheel 21 by a yarn transport device mounted on the frame part 11'. The yarn transport device may include a deflecting roller 31 associated with a driven godet 30. The yarn runs through a yarn guide 29. It is then guided once again to the godet 30 and back to a deflecting roller 31. The yarn 20 loops several times around the godet 30 and deflecting roller 31 before it goes to the wheel 31 and after the yarn 20 returns from the wheel 21 to drive the same with a zero slippage, the yarn then runs from the godet 30 to a circularly cylindrical thin pin 25 which deflects the yarn to the friction roller 12. The thin pin 25 is mounted on a forward end of the wheel 21. The pin 25 is disposed eccentrically on the wheel 21 and has a longitudinal axis which extends in parallel to the axis of rotation of the wheel 21.

The yarn transport device of the present invention formed by the godet 30 and deflecting roller 31 may actually be viewed as constituting a first and second transport device. More particularly, the yarn 20 envelops or surrounds the godet 30 and extends to the driving surface of the wheel 21 so as to drive the wheel 21. The yarn 20 then returns to the godet 30 and deflecting roller 31 where it once again surrounds the godet 30 and is then transported to the yarn deflecting element 25 and directed to the sleeve 14 or yarn winding body 15. Thus, as viewed in FIG. 1, the right side of the godet 30 and roller 31 may be considered a first transport device since the yarn 20 first surrounds the godet 30 for its drive and then continues to the left side of the godet 30 and back to the deflecting element 25. Thus, the right side of the illustrated yarn transport device, i.e., godet 30 and roller 31 may be considered a first yarn transport device for feeding yarn 20 to the wheel 21 for driving the same, with the left side of the illustrated transport device being a second yarn transport device feeding the yarn 20 to the driving surface of the wheel 21.

As can readily be appreciated, it would be possible to provide two yarn individual transport devices in a manner not shown in the drawing. In this connection one transport device would be arranged upstream of the driving surface of the wheel 21 and would be adapted to feed the yarn 20 only to the driving surface of the wheel 21 and not the deflecting element.

The pin 25 confers very rapid modulating stroke movements on the yarn 20 by virtue of the travel of the pin 25 around the axis of the wheel 21 along a circular path so that the winding takes place in the form of sinusoidal wavy lines on the sleeve 14 causing the windings of each winding layer to be wound on with mutual intersection. The yarn 20 extends or runs from the pin 25 to the back of the friction roller 12 facing away from the viewer in FIG. 1, and the yarn 20 loops around the cylindrical circumference of the friction roller 12 to slightly more than 180° and is then wound directly upon the yarn winding body 15, driven only by the friction roller 12, beginning at the contact line at which the yarn winding body 15 abuts the friction roller 15.

In a practical test of the yarn winding device done on the present invention, the winding values which were determined were as follows:

Winding speed—700 m/min;
Axial length of yarn winding body—30 cm;
Length of time of a single stroke of the guide bar 19—30 sec;
Length of modulating stroke of yarn when running onto the friction roller—14 mm;
Diameter of annular groove in wheel 21—55 mm.

It is to be noted that the diameter of the circular path of the pin 25 is greater than the modulating stroke of the yarn 20 on the friction roller 12.

FIG. 3 provides an example of another construction of a wheel generally designated by the reference numeral 21'. The wheel 21' differs from the wheel 21 by virtue of the fact that the wheel 21' has a round driving surface provided with two mutually coaxial annular grooves 27, 27' of different diameters and also that the pin 25 is replaced by a roller 25''' rotatably mounted on the wheel 21' to rotate about an eccentrically mounted axis of rotation. The roller 25''' deflects the yarn 20 to the friction roller 12 and generates the modulating strokes. The yarn 20 may be displaced between the grooves 27, 27' by means of a yarn guide 24 which is linearly displaceable by, for example, hydraulic, pneumatic, electrical, mechanical, or servo drive 33. The linear displacement of the yarn guide 24 is parallel to the axis of rotation of the wheel 21' and the displacement is carried out in a predetermined periodic or aperiodic rhythm so as to transfer the yarn 20 from the annular groove 27 to the groove 27' and back again. The transfer of the yarn between the grooves 27, 27' causes the rotational speed of the wheel 21 to change accordingly while the yarn speed remains constant so that the ratio V, that is, the ratio of the length of the modulating stroke to the length of yarn wound on during one modulating stroke, can change during winding on so that the winding composition may even further be improved thereby while at the same time the mirror formation can be offset by using even smaller modulating strokes. It is also possible to provide more than two annular grooves of different diameter.

As shown in FIG. 6, it is possible to optionally provide for a constant variation of the rotational speed of the wheel and, for this purpose, a wheel generally designated by the reference numeral 21'' is provided with a conical drive surface 27''. The yarn 20 rests against the driving surface 27'' of the driving wheel 21'', with the yarn being adapted to be displaced back and forth periodically or aperiodically by means of the yarn guide 24 which is positioned adjustable by the drive means 33. The displacement of the yarn 20 by the yarn guide 24 is parallel to the axis of rotation of the wheel 21''.

FIGS. 4A–4H provide an illustration of a wheel 21''' in eight different angular positions staggered 45° with respect to one another. The wheel 21''' is provided with two pins 25', 25'' which rotate along the same circular path and are separated from each other by an angle of 180°. The pins 25', 25'' are illustrated in the drawings by a circle and a dot so as to distinguish the pins from each other and so as to enable an understanding of the production of the modulating strokes in the manner shown. When the diameter of the circle of pins 25', 25'' corresponds to the diameter of the circular path of the pin 25 in FIG. 1, a decrease in the length of the modulating stroke will double the frequency of the modulating strokes. Moreover, the changes in length of the yarn length between the godet 30 and friction roller 12 caused by the modulating strokes is extraordinarily small for the wheel 21'''. The circular path of the two pins 25', 25'' of the wheel 21''', as shown in FIG. 4, may be made larger than the wheel 21 in FIG. 1, whereby a length of the modulating strokes increases but changes in length of the length of the yarn still remain especially small.

To reduce the change of length of the yarn between the godet 30 and friction roller 12 which occurs during each modulating stroke, it is also possible as shown, for example, in FIGS. 5A and 5B, to dispose a deflecting bar 35 between the wheel 21 and friction roller 12. The deflecting bar 35 is fastened to the guide bar 19 and is arranged at such an angle that it deflects the yarn during the modulating stroke at an angle to the lifting direction and at an angle to a direction of travel in such a fashion that in the uppermost position of the pin 25, the yarn is deflected laterally to the furthest extent while in the lowest position of the pin 25, the yarn is deflected laterally to the least extent, or not at all.

If the yarn deflecting pins such as the pins 25, 25' or 25'' or roller 25''' are sufficiently long, the yarn is reliably prevented from slipping off accidentally during operation and the pins or roller may be made straight up to their free ends. However, it is also possible to provide a slipping element at the free end of the pins or roller to prevent a slipping down of the yarn. A slipping element may, for example, be a thin coaxial disc or, alternatively, the roller 25''' may be provided with an annular groove for the yarn and so on.

While we have shown and described several embodiments in accordance with the present invention, it is understood that the same is not limited thereto but is susceptible of numerous changes and modifications as known to one having ordinary skill in the art, and we therefore do not wish to be limited to the details as shown and described herein but intend to cover all such modifications as are encompassed by the scope of the appended claims.

We claim:

1. A high speed yarn winding device for forming a parallel winding for yarn windings which intersect within each winding layer, the device comprising a yarn winding body means for receiving the yarn, means for interchangeably and rotatably carrying the winding body means, means for directly supplying yarn to the winding body means, guide means displaceable in parallel to an axis of rotation of the winding body means, and wheel means rotatably mounted on the guide means for deflecting the yarn to the supplying means so as to superimpose rapid and short modulating strokes on the displacement of the guide means to wind the yarn into the parallel winding, characterized in that the wheel means includes at least one round driving surface means arranged concentric to an axis of rotation of the wheel means for enabling the yarn to drive the wheel means, and at least one yarn deflecting element is disposed eccentrically on the wheel means, and in that yarn transport means are for driving the wheel means and for feeding the yarn to the at least one yarn deflecting element.

2. A high speed yarn winding device according to claim 1, characterized in that the means for directly supplying includes a friction roller at least partially looped by the yarn to be wound, the friction roller is arranged so as to be rotatable about a substantially vertical axis of rotation, said means for carrying the winding body means are adapted to bring the winding body means into a position wherein an outer circumference of the winding body means is in abutment with the friction roller so as to provide for a rotary drive for the winding body means.

3. A high speed yarn winding device according to claim 2, characterized in that the guide means includes a guide bar adapted to execute lifting movements parallel to the axis of rotation of the friction roller, and in that the friction roller is cylindrical.

4. A high speed yarn winding device according to claim 3, characterized in that at least one yarn deflecting element includes a straight cylindrical yarn deflecting area disposed axially parallel to the axis of rotation of the wheel means.

5. A high speed yarn winding device according to claim 4, characterized in that the deflecting area of at least one deflecting element has a diameter of between 1–3 mm.

6. A high speed yarn winding device according to claim 4, characterized in that the deflecting area of at least one deflecting element has a diameter of about 4 mm.

7. A high speed yarn winding device according to one of claims 4, 5, or 6, characterized in that at least one deflecting element includes a pin permanently mounted on the wheel means.

8. A high speed yarn winding device according to claim 7, characterized in that the yarn transport means includes a driven godet and a displacement roller associated therewith.

9. A high speed yarn winding device according to one of claims 1, 2, or 3, characterized in that at least one yarn deflecting element is a roller mounted on the wheel means so as to be rotatable about a longitudinal axis thereof, and in that an axis of rotation of the roller is parallel to the axis of rotation of the wheel means.

10. A high speed yarn winding device according to claim 9, characterized in that the yarn transport means includes a first yarn transport connected in series with the wheel means for feeding the yarn to the wheel means so as to drive the same and a second yarn transport for feeding yarn to the at least one yarn deflecting element.

11. A high speed yarn winding device according to claim 10, characterized in that the first and second yarn transport means are formed from a single driven godet.

12. A high speed yarn winding device according to one of claims 1, 2, or 3, characterized in that a plurality of driving surface means are provided, each of the driving surface means are concentric to the axis of rotation of the wheel means and have different diameters, means are provided for selectively positioning the yarn on the respective driving surface means so as to change a rotational speed of the wheel means.

13. A high speed yarn winding device according to claim 12, characterized in that the means for selectively positioning the yarn includes a yarn guide mounted so as to be displaceable approximately parallel to the axis of rotation of the wheel means, means are provided for adjusting a position of the yarn guide, and drive means are provided for actuating the position adjusting means.

14. A high speed yarn winding device according to claim 13, characterized in that the drive means is adapted to periodically displace the yarn guide back and forth.

15. A high speed yarn winding device according to claim 13, characterized in that the driving surface means are formed by annular grooves arranged in the wheel means.

16. A high speed yarn winding device according to claim 13, characterized in that the yarn support surface means are formed by a single frustoconical surface.

17. A high speed yarn winding device according to one of claims 2 or 3, characterized in that a deflecting guide is provided on the guide means, the deflecting guide being arranged so as to extend diagonally with respect to the friction roller, the deflecting guide being adapted to deflect the yarn at a position between at least one deflecting element and the friction roller so as to deflect the yarn out of the shortest path to the friction roller diagonally with respect to a modulating stroke direction in such a fashion that changes in the length of the yarn located between the yarn transport means and a run-on point of the yarn on the friction roller are reduced, with the changes in length being caused by the modulating strokes.

18. A high speed yarn winding device according to one of claims 1, 2, or 3, characterized in that the parallel windings are provided with tapered ends.

* * * * *